US009970275B2

(12) United States Patent
Sultenfuss et al.

(10) Patent No.: US 9,970,275 B2
(45) Date of Patent: May 15, 2018

(54) EM AND COMBUSTION STIMULATION OF HEAVY OIL

(71) Applicants: ConocoPhillips Company, Houston, TX (US); Harris Corporation, Melbourne, FL (US)

(72) Inventors: Daniel R Sultenfuss, Houston, TX (US); Mark Alan Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 601 days.

(21) Appl. No.: 14/010,799

(22) Filed: Aug. 27, 2013

(65) Prior Publication Data

US 2014/0090834 A1 Apr. 3, 2014

Related U.S. Application Data

(60) Provisional application No. 61/708,802, filed on Oct. 2, 2012.

(51) Int. Cl.
*E21B 43/24* (2006.01)
*E21B 43/243* (2006.01)

(52) U.S. Cl.
CPC ..... *E21B 43/2401* (2013.01); *E21B 43/243* (2013.01)

(58) Field of Classification Search
CPC .... E21B 43/2401; E21B 43/243; E21B 43/16; E21B 43/166; E21B 43/168; E21B 43/24; E21B 43/305
See application file for complete search history.

(56) References Cited

U.S. PATENT DOCUMENTS

| | | | | |
|---|---|---|---|---|
| 2,685,930 | A | 8/1954 | Albaugh | |
| 3,024,841 | A * | 3/1962 | Willman | E21B 43/243 166/261 |
| 4,705,108 | A | 10/1987 | Little | |
| 5,443,118 | A * | 8/1995 | Yannimaras | E21B 43/243 166/251.1 |
| 6,412,557 | B1 * | 7/2002 | Ayasse | E21B 43/243 166/245 |
| 7,975,763 | B2 | 7/2011 | Banerjee | |
| 2009/0188667 | A1 * | 7/2009 | Lim | E21B 43/243 166/256 |
| 2010/0065265 | A1 * | 3/2010 | Kasevich | E21B 43/003 166/248 |
| 2010/0078163 | A1 * | 4/2010 | Banerjee | E21B 43/2408 166/248 |

(Continued)

FOREIGN PATENT DOCUMENTS

| | | |
|---|---|---|
| WO | 2012037176 | 3/2012 |
| WO | 2012037221 | 3/2012 |

(Continued)

OTHER PUBLICATIONS

Antenna—definition of antenna by the Free Dictionary, Jul. 12, 2016, www.thefreedictionary.com/antenna, HarperCollins Publishers, 2009, pp. 1-4.*

(Continued)

*Primary Examiner* — Caroline N Butcher
(74) *Attorney, Agent, or Firm* — Boulware & Valoir

(57) ABSTRACT

A method of producing heavy oil from a heavy oil formation by combining electromagnetic heating to achieve fluid communication between wells, following by in situ combustion to mobilize and upgrade the heavy oil.

18 Claims, 8 Drawing Sheets

(56) References Cited

U.S. PATENT DOCUMENTS

| | | | | |
|---|---|---|---|---|
| 2010/0243249 | A1* | 9/2010 | Fang | E21B 43/2406 166/272.3 |
| 2011/0061868 | A1* | 3/2011 | Bailey | E21B 43/2408 166/272.3 |
| 2011/0253363 | A1* | 10/2011 | Banerjee | E21B 43/2406 166/248 |
| 2012/0067580 | A1* | 3/2012 | Parsche | E21B 43/2401 166/302 |
| 2012/0085537 | A1 | 4/2012 | Banerjee | |
| 2012/0090844 | A1 | 4/2012 | Madison | |
| 2012/0267095 | A1 | 10/2012 | Dreher | |
| 2012/0305239 | A1 | 12/2012 | Sultenfuss | |
| 2013/0199774 | A1 | 8/2013 | Sultenfuss | |

FOREIGN PATENT DOCUMENTS

| | | |
|---|---|---|
| WO | 2012037147 | 5/2012 |
| WO | 2012037230 | 5/2012 |
| WO | 2012037334 | 5/2012 |
| WO | 2013089973 | 6/2013 |
| WO | PCT/US2013/056731 | 1/2014 |

OTHER PUBLICATIONS

A. Sahni, et al, Electromagnetic Heating Methods for Heavy Oil Reservoirs (2000).

Heavy Oil and Natural Bitumen Resources in Geological Basins of the World: Open File-Report 2007-1084 (US Geological Survey 2007).

Davletbaev et al, Heavy Oil and Bitumen Recovery Using Radiofrequency Electromagnetic Irradiation and Electrical Heating: Theoretical Analysis and Field Scale Observations (2010).

I. Bogdanov, et al., Comparative Analysis of Electromagnetic Methods for Heavy Oil Recovery (2011).

* cited by examiner

MOBILITY OF OIL IS INCREASED BY REDUCED VISCOSITY CAUSED BY HEAT AND SOLUTION OF COMBUSTION GASES

EM AND COMBUSTION STIMULATION OF HEAVY OIL

CROSS-REFERENCE TO RELATED APPLICATIONS

This application claims priority to U.S. Ser. No. 61/708,802, filed Oct. 2, 2012, and incorporated by reference in its entirety.

STATEMENT REGARDING FEDERALLY SPONSORED RESEARCH

None.

FIELD OF THE INVENTION

A method of stimulating heavy oil by combined electromagnetic heating and air injection to allow limited combustion is presented.

BACKGROUND OF THE INVENTION

Bitumen—colloquially known as "tar" due to its similar appearance, odor, and color—is a thick, sticky form of crude oil. It is so heavy and viscous that it will not flow unless either heated or diluted with lighter hydrocarbons. Bituminous sands—known as oil sands or tar sands—contain naturally occurring mixtures of sand, clay, water, and bitumen and are found in extremely large quantities in Canada and Venezuela.

Conventional crude oil is normally extracted from the ground by drilling oil wells into a reservoir, and allowing oil to flow into the wells under natural reservoir pressures. Artificial lift techniques, such as water flooding and gas injection, are usually required to maintain production as reservoir pressure drops toward the end of a field's life, but initial production proceeds under normal reservoir pressures and temperatures.

Oil sands are very different however. Because extra-heavy oil and bitumen flow very slowly (if at all) toward producing wells under normal reservoir conditions, oil sands must be extracted by strip mining or made to flow into wells by techniques designed to reduce the viscosity of the heavy oil. Such methods are called "enhanced oil recovery" (EOR) methods.

There are several EOR methods used to produce heavy oils that use steam as a source of heat to mobilize the heavy oil. In Cyclic Steam Stimulation (CSS) or the "huff-and-puff" method, the well is put through cycles of steam injection, soak, and oil production. First, steam is injected into a well at a temperature of 300-340° C. for a period of weeks to months. Then, the well is allowed to sit for days to weeks to allow heat to soak into the formation, and, later, the hot oil is pumped out of the well for a period of weeks or months. Once the production rate falls off, the well is put through another cycle of injection, soak and production. The process is repeated until no longer cost effective. The CSS method recovery factor is around 20 to 25, but the cost to inject steam is high.

Steam assisted gravity drainage (SAGD) was developed in the 1980s and fortuitously coincided with improvements in directional drilling technology that made it quick and inexpensive to do by the mid 1990s. In SAGD, (at least) two horizontal wells are drilled in the oil sands, one at the bottom of the formation and another about 5 meters above it. Steam is injected into the upper well where the heat melts the heavy oil, which allows it to flow via gravity into the lower well, where it can be pumped to the surface. SAGD can be more cost effective than CSS in some formations, and allows very high oil production rates, and recovers up to 60% of the oil in place.

While being a breakthrough technology, the SAGD method is very costly in terms of water usage. The 1995 per-capita usage of water in the United States was estimated to be about 350 gal/day/person. Further, the American Petroleum Institute (API) estimates that 71% of produced water is being used for EOR methods, 21% is being injected for disposal, and 3% going to percolation and evaporation ponds, while only 5% is applied to beneficial uses such as for livestock, irrigation, etc. In fact, water is the largest waste stream produced by the oil & gas industry as a whole. Clearly, less water intensive methods would be of benefit to society as a whole, freeing up water usage for agrarian and humanitarian uses. Further, the water itself can damage the reservoir, since many of the oil sands contain clay that can swell on contact with water, thus reducing their permeability. Also, many reservoirs sites only have limited local water. Thus, there are many reasons for developing non-water based enhanced oil recovery techniques.

Some enhanced oil recovery (EOR) methodologies use solvents, instead of steam, to separate bitumen from sand. Solvent use can be beneficial if it does not approach the energy needed to produce steam. Also, as opposed to water that must be impounded and/or treated before release, solvent can be easily removed from the sands and re-used.

Vapor Extraction Process (VAPEX) is an in situ technology, similar to SAGD. Instead of steam, hydrocarbon solvents are injected into an upper well to dilute bitumen and enable the diluted bitumen to flow into a lower well. It has the advantage of much better energy efficiency over steam injection, and it allows some partial upgrading of bitumen to oil right in the formation.

The above methods are not mutually exclusive of course. It is becoming common for wells to be put through one CSS injection-soak-production cycle to condition the formation prior to going to SAGD production, and companies are experimenting with combining VAPEX with SAGD to improve recovery rates and lower energy costs.

In situ combustion (ISC) of heavy oil can also provide the heat to mobilize the heavy oil and can provide some in situ upgrading at the same time. This process is also known as "fire flooding." Either dry air or air mixed with water is injected into the reservoir, and ideally, the fire propagates uniformly from the air injection well to the producing well, moving oil and combustion gases ahead of the burning front, and leaving coke behind the mobilized oil to provide the fuel for the combustion. See FIG. 1 for an exemplary ISC process.

Except in a few rare situations, in situ combustion has not been successfully applied. The fire front can be difficult to control, and may propagate in a haphazard manner resulting in premature breakthrough to a producing well. There is also a danger of a ruptured well with hot gases escaping to the surface. Temperatures in the thin combustion zone may reach several hundred degrees centigrade, so that the formation and completion hardware can be severely stressed.

Further, the produced fluid may contain an oil-water emulsion that is difficult to break. As with output from many heavy oil projects, it may also contain heavy-metal compounds that are difficult to remove in the refinery. In situ combustion eliminates the need for natural gas to generate steam, but significant energy is still required to compress and pump air into the formation.

Toe to Heel Air Injection (THAI) is variation of the in situ combustion method that combines a vertical air injection well with a horizontal production well. The process ignites oil in the reservoir and creates a vertical wall of fire moving from the "toe" of the horizontal well toward the "heel", which burns the heavier oil components and upgrades some of the heavy bitumen into lighter oil right in the formation. Although fireflood projects have not worked out well because of difficulty in controlling the flame front and a propensity to set the producing wells on fire, some believe the THAI method will eventually be more controllable, and in situ combustion techniques have the advantage of not requiring energy to create steam. Advocates of this method of extraction state that it uses less freshwater, produces 50% less greenhouse gases, and has a smaller footprint than other production techniques. An exemplary THAI method is shown in FIG. 2.

"CAPRI" is the variant of the THAI process that adds an annular sheath of solid catalyst surrounding the horizontal producer well. Thermally cracked oil produced by THAI passes through the layer of catalyst en-route to the horizontal producer well. Laboratory tests indicate that the combination of THAI and CAPRI can achieve significant upgrading. However, it is not clear that CAPRI can upgrade heavy oil to the point where it can be transported by pipeline without diluent. Thus, although a very promising technology, there is room for improvement.

Combustion Overhead Gravity Drainage (COGD) is another variant in situ combustion method that employs a number of vertical air injection wells above a horizontal production well located at the base of the bitumen pay zone. An initial Steam Cycle similar to CSS is used to prepare the bitumen for ignition and mobility. Following that cycle, air is injected into the vertical wells, igniting the upper bitumen and mobilizing (through heating) the lower bitumen to flow into the production well. It is expected that COGD will result in water savings of 80% compared to SAGD.

Finally, some companies are now experimenting with using electromagnetic (EM) energy to mobilize oil. Electrical heating tools and applications can be divided into two categories based on the frequency of the electrical current used. First, in low frequency mode (less than 60 Hz), currents are used for resistive heating. In this mode it is assumed that resistance heating dominates the process and other factors are negligible. Here the depth of penetration is high but the intensity low.

The second mode is a high frequency mode, wherein the currents are used in microwave (MW) or radio frequency (RF) range. The use of high frequencies for downhole dielectric heating has significant potential applications to heavy oil recovery. EM heating does not require a heat transporting fluid such as steam or a hot fluid injection process, which avoids the complications associated with generating and transporting a heated fluid, and allows it to be applied in wells with low incipient injectivity. EM heating can apply to situations where generating and injecting steam may be environmentally unacceptable (i.e., through permafrost), no wastewater disposal is required, and conventional oil field and electrical equipment can be used, which makes this technique very attractive for offshore heavy-oil recovery, though it has not yet been applied there. Furthermore, a single well can be used to introduce energy to the formation through a power source as well as to recover produced fluids. Production may occur during or immediately after EM heating if the formation pressure is large enough.

Inductive heating is a related technology that is sometimes distinguished from RF heating, and may use different electrode geometry, but fundamentally is based on the same principles.

Although promising, the value of RF or MW heating of reservoirs has yet to be fully realized, perhaps due to the lack of adequate modeling and difficulties in antenna design and placement, and difficulties with the durability of equipment. However, several companies are investigating this methodology and seeking ways of practical implementation.

One inherent problem with electrode systems is that they require either a new well with a completion designed especially for the system or a very extensive and often impractical re-working of an existing well.

Another problem is that oil reservoirs are not homogeneous and are often formed of layers of sediment of different physical and electrical characteristics. This leads to uneven heating wherein the least productive layers are heated the most, and surface temperatures near the ends of the electrodes can reach uncontrollably high levels causing their failure.

Electrode systems, whose test results have been reported, require the use of single phase, alternating current. Alternating current is used rather than direct current in order to maintain electrolytic corrosion in the well to an acceptable level. Electrode systems that utilize either a power cable or an insulated tubing string to deliver power to the electrodes can be operated at AC frequencies below normal power frequencies. This is done to minimize overheating that can occur in the power delivery system due to the induced currents that are generated in the ferromagnetic steel of the well casing and well accessories. Despite operating at quite low frequencies, damaging overheating can still result.

Electrode systems are fundamentally limited in the combined length of the electrodes being used, and, therefore, the thickness of exposed reservoir face that can be heated. The reason for this is that the efficiency of the electrode system is determined by the ratio of the electrical impedance of the electrodes divided by the electrical impedance of the entire system. The impedance of the electrodes is inversely proportional to their length and a function of the resistivity of the reservoir formation in contact with the electrodes.

The resistivities of oil bearing formations vary greatly depending primarily on their porosity and their saturation with oil, water, and gas. Also, the resistivity of the formation declines as its temperature increases; therefore, the impedance of the electrodes and the efficiency of the system go down as the formation face is heated. As a result of all these factors, the maximum thickness of sand face that can be efficiently heated with these systems is about fifteen meters.

One particularly intractable problem with electrode systems is that electrical tracking seems to inevitably occur across the surface of insulators exposed to the produced fluids from the wells. These fluids often are composed of two liquid phases, oil and salt water. At the electrical potential differences across insulators used in these systems, sparking occurs at the oil/water interface laying down a progressively larger track of carbon residue. Eventually a conductive path is formed, and sudden high currents can interrupt operations by blowing fuses and tripping breakers. If operations continue, production casing failures can occur, requiring abandonment or expensive recompletion of the well.

All of these problems have limited the usefulness of EM heating of reservoirs, which suggests that EM heating might benefit in a more limited application, where other methodologies also contribute to heat and drive mechanisms.

Thus, what is needed in the art is a method of improving the cost effectiveness of recovering heavy oils, even in heterogeneous reservoirs that are vertically compartmentalized.

BRIEF SUMMARY OF THE DISCLOSURE

Generally speaking, the method uses electromagnetic radiation to heat a bitumen or heavy oil reservoir followed by air injection to create a combustion front. Fluids that are immobile at usual reservoir conditions can be heated with electromagnetic radiation to allow pressure communication across the reservoir. Once sufficient mobility is achieved, injected air can be used to create a combustion front in the reservoir and provide pressure support to the reservoir.

In more detail, the inventive method comprises:

- providing an air injection borehole and a production borehole in a reservoir comprising heavy oil;
- providing an antenna operably connected to a power source in said air injection borehole or said production borehole or both boreholes;
- heating said heavy oil with electromagnetic (EM) radiation via said antenna until said air injection borehole and said production borehole are in fluid communication;
- injecting air into said air injection borehole and allowing a combustion front to mobilize said heavy oil; and
- producing said mobilized heavy oil from said production borehole.

Preferred embodiments include one or more of the following:

- The production borehole is a horizontal borehole.
- Both air injection and production boreholes are horizontal boreholes, the production borehole being lower than injection boreholes, preferably about 3-5 meters below. Preferably, there are multiple injection and production boreholes, as appropriate to cover a specific play.
- Injection boreholes can have duel function as production boreholes.
- The combustion also upgrades the heavy oil.
- The EM is at a frequency of 1 kHz-100 MHz.
- The antenna is a dipole antenna.
- Each injection and/or each production borehole is quipped with an antenna nearby or collocated therewith.
- One or more production boreholes or portions thereof includes an upgrading catalyst.
- Ignition can occur spontaneously, or be initiated by the drill crew.

Also taught are improved methods of in situ combustion, wherein air is injected into an injection well and heavy oil is mobilized by a combustion front to be produced at a production well, the improvement comprising first preheating the injection and production wells with electromagnetic radiation until the wells are in fluid communication before injecting air into said injection well.

Another embodiment is an improved method of gravity assisted in situ combustion, wherein air is injected into one or more injection wells and heavy oil is mobilized by a combustion front to be produced at one or more horizontal production wells, the improvement comprising first preheating the injection and production wells with electromagnetic radiation of a frequency between 1 Khz-100 MHz until the wells are in fluid communication before injecting air into said injection wells.

The ignition may be spontaneous, as is known to occur, or can be assisted with downhole ignition devices, such as gas-fired burners, catalytic heaters, or electric heaters, or chemically assisted by injecting more volatile gases downhole. However, electric heaters may be preferred as the easiest to control.

The oxidizing agent can be any known, but is preferably air, which is inexpensive, available on site, and less explosive than purer $O_2$ gases are. Mixed gases, such as $CO_2/O_2$ mixtures, can also be employed, as is known in the art.

The EM heating device may use a surface located active electrical current source operating at radio or microwave frequencies to couple electrical energy to one or more antennas in the hydrocarbon formation. The active electrical source may be a semiconductor device such as a ceramic metal oxide junction (CMOS) or like devices capable of transresistance.

The coupling mechanism between the electrical source and the antenna may be an open wire transmission line, a closed wire transmission line or a guided wire transmission line. The transmission line advantageously reduces transmission loss relative to unguided transmission. The guided wire transmission line may be advantageous for ease of installation with a cable tool type drilling apparatus, as will be familiar to those in the hydrocarbon arts.

The transmission line may utilize one or more of a forward wave, a reflected wave or a standing wave to convey the electrical currents. The characteristic impedance of the transmission line may be between 25 ohms and 300 ohms, although the invention is not so limited as to require operation at specific characteristic impedance. The higher impedances may reduce $I^2R$ losses in conductive materials while the lower impedances may allow smaller dielectric dimensions.

In one embodiment of the present invention the EM preheating stage that utilizes an EM lineal power density in the range from 0.5 kW/m to 8 kW/m of the lateral well length.

The EM heating device includes an antenna to convert electrical currents into heating energies such as radio waves and microwaves. Preferred antennas include a dipole and half dipole antenna, or a half dipole plus N antenna, where n is an integer. Other antennas include isotropic antennas, omnidirectional antennas, polar antennas, logarithmic antennas, yagi-uda antennas, microstrip patches, horns, or reflectors antennas. The isotropic antenna may be used to diffuse the heating energy in a nondirectional fashion. As can be appreciated by those in the art, radiated waves are created by the Fourier transform of current distributions in the antenna.

The EM generator may produce microwaves or radio waves that have frequencies ranging from 0.3 gigahertz (GHz) to 100 GHz. For example, the microwave frequency generator may introduce microwaves with power peaks at a first discrete energy band around 2.45 GHz associated with water and a second discrete energy band spaced from the first discrete energy band. The Debye resonance of water in the vapor phase at 22 GHz is another example frequency. In other embodiments, a reduced frequency can be used, e.g., in the between 100 MHz and 1000 MHz.

Lower frequency radio waves are preferred, however, because microwaves do not have the penetration range that low frequency radio waves have and do not penetrate deep enough into the formation. Thus, preferred frequencies include 1 KHz-100 MHz. In a preferred embodiment, the heating energies are electromagnetic energies such as waves to heat the hydrocarbon molecules by resonance, dissipation, hysteresis, or absorption.

The antenna can be arranged in any pattern, but preferably collocate with each borehole, which are arranged in repeating patterns to suitably cover a play. The antenna can be at or in the borehole, or provided suitably nearby, but collocating the antenna with the original well may be the most cost effective approach.

The method can be used in combination with any gravity drive mechanisms, such as in COGD or THAI methods. Furthermore, the method can be combined with one or more existing stimulation methodologies, such as steam based EOR methods, solvents based EOR methods, catalytic upgrading in the production well, and the like. However, in preferred methods, steam usage is eliminated or reduced as much as possible.

As mentioned, the inventive method can also be combined with the use of in situ catalysts for further in situ upgrading. Options for introducing catalyst into the reservoir include pack bed catalysts that line the inside of the producer well or ones that may be injected into the reservoir by slurry or emulsion. The catalyst is not limited in its form, but a packed bed catalyst lining may be preferable in the present invention. A loosely filled packed bed may also be useable if the packing does not overly inhibit flow, and such fill can be injected into the reservoir as a slurry or emulsion. Other formats such as baffles, plates, trays, and other structured packing formats are also possible.

Specific catalysts that facilitate upgrading for this process will ideally be less susceptible to poisoning by sulfur species, water oxidation, nitrogen or heavy metal poisoning or other forms of potential transition metal catalyst poisoning. Some examples of possible hydroprocessing catalysts that may be applicable are metal sulfides ($MoS_2$, $WS_2$, CoMoS, NiMoS, etc.), metal carbides (MoC, WC, etc.) or other refractory type metal compounds such as metal phosphides, borides, etc. It is not anticipated that reduced metal catalysts will remain active for a long period of time in this application, and, in such cases, catalyst regeneration techniques may be required.

In some upgrading reactions, additional $H_2$ may need to be provided. Hydroprocessing reactions of the type expected (desulfurization, olefin and aromatic saturation, hydrocracking) can occur between hydrogen pressures of 50 psi to several thousand psi $H_2$. It is anticipated to provide $H_2$ at as high partial pressure as feasible. This can be from between 50 and 1200 psi $H_2$ and preferably between 600 to 800 psi $H_2$. The ultimate hydrogen pressure in practice will be determined via experimental testing. The space velocity of the hydrocarbon in the catalyst/hydrogen zone should be between 0.05 to 1.0 $hr^{-1}$ or more preferably between 0.2 and 0.5 $hr^{-1}$.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise," "have," and "include" (and their variants) are open-ended linking verbs and allow the addition of other elements when used in a claim. The phrase "consisting of" excludes other elements. The term "consisting essentially of" occupies a middle ground, allowing the inclusion of nonmaterial elements, such as buffers, salts, proppants, and the like, that do not materially change the novel features or combination of the invention.

The following abbreviations are used herein:

| | |
|---|---|
| COGD | Combustion Overhead Gravity Drainage |
| EM | Electromagnetic |
| ISC | In situ combustion |
| MW | Microwave |
| RF | Radio frequency |
| SAGD | Steam assisted gravity drainage |
| SCTR | Sector |
| THAI | Toe to Heel Air Injection |

As used herein "upgrading" refers to chemical and/or physical reactions that breaks down the hydrocarbon into molecules of lower carbon number or removes impurities from the crude oil.

The term "hydroprocessing" may include hydrotreating, hydrocracking desulfurization, olefin and aromatic saturation/reduction, or similar reactions that involves the use of hydrogen. Through hydroprocessing, the viscosity of the crude oil may be reduced, thus more readily produced and transported. Through the removal of impurities the quality of the crude oil can be improved, thus facilitating subsequent processing and saving operational costs.

The term "providing" herein is meant to both direct and indirect methods of obtaining access to an object. Thus "providing a well" includes both drilling a new well, as well as using or retrofitting existing wells.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
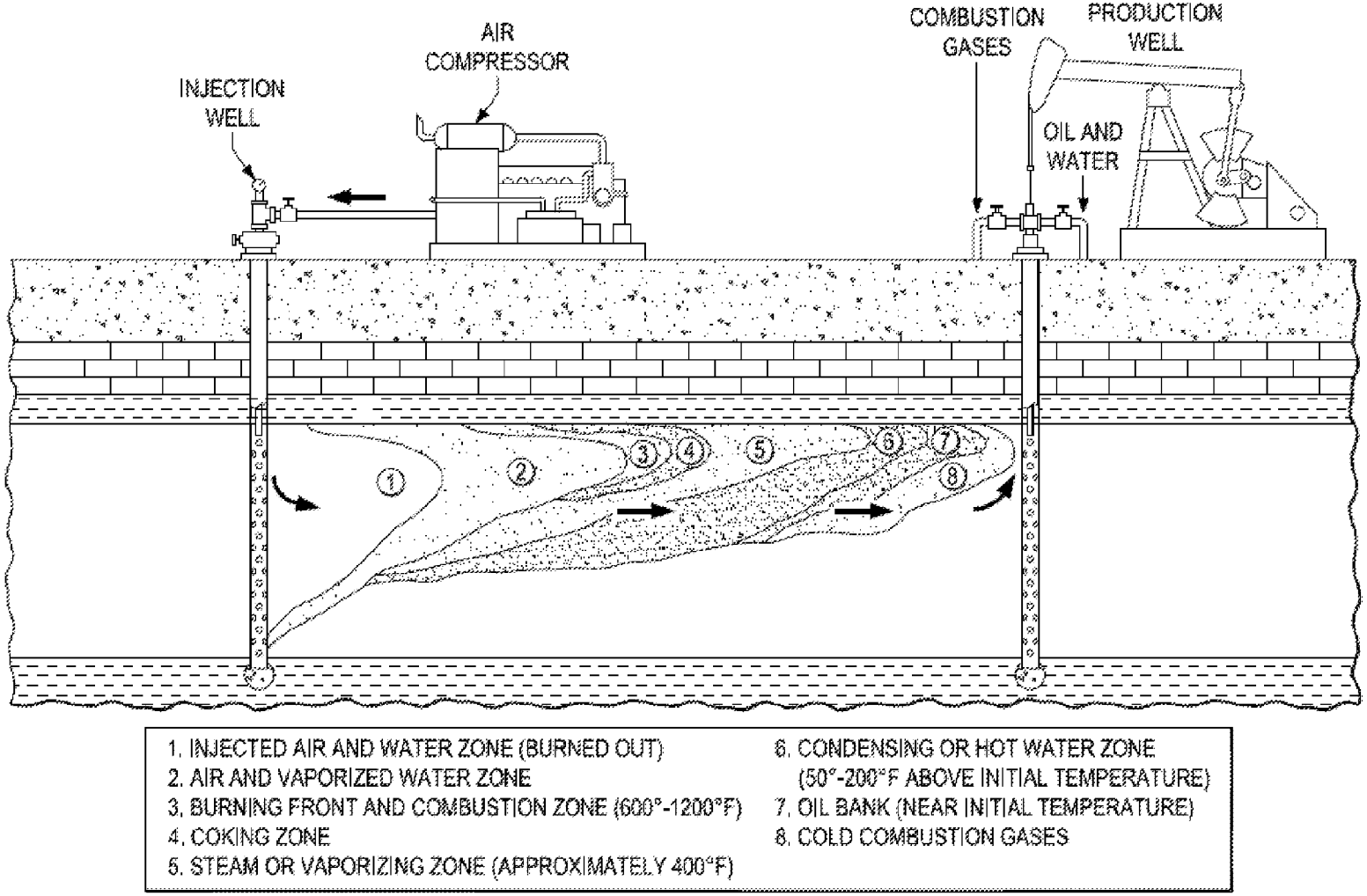
FIG. 1 shows a typical in situ combustion method.
Figure 2:
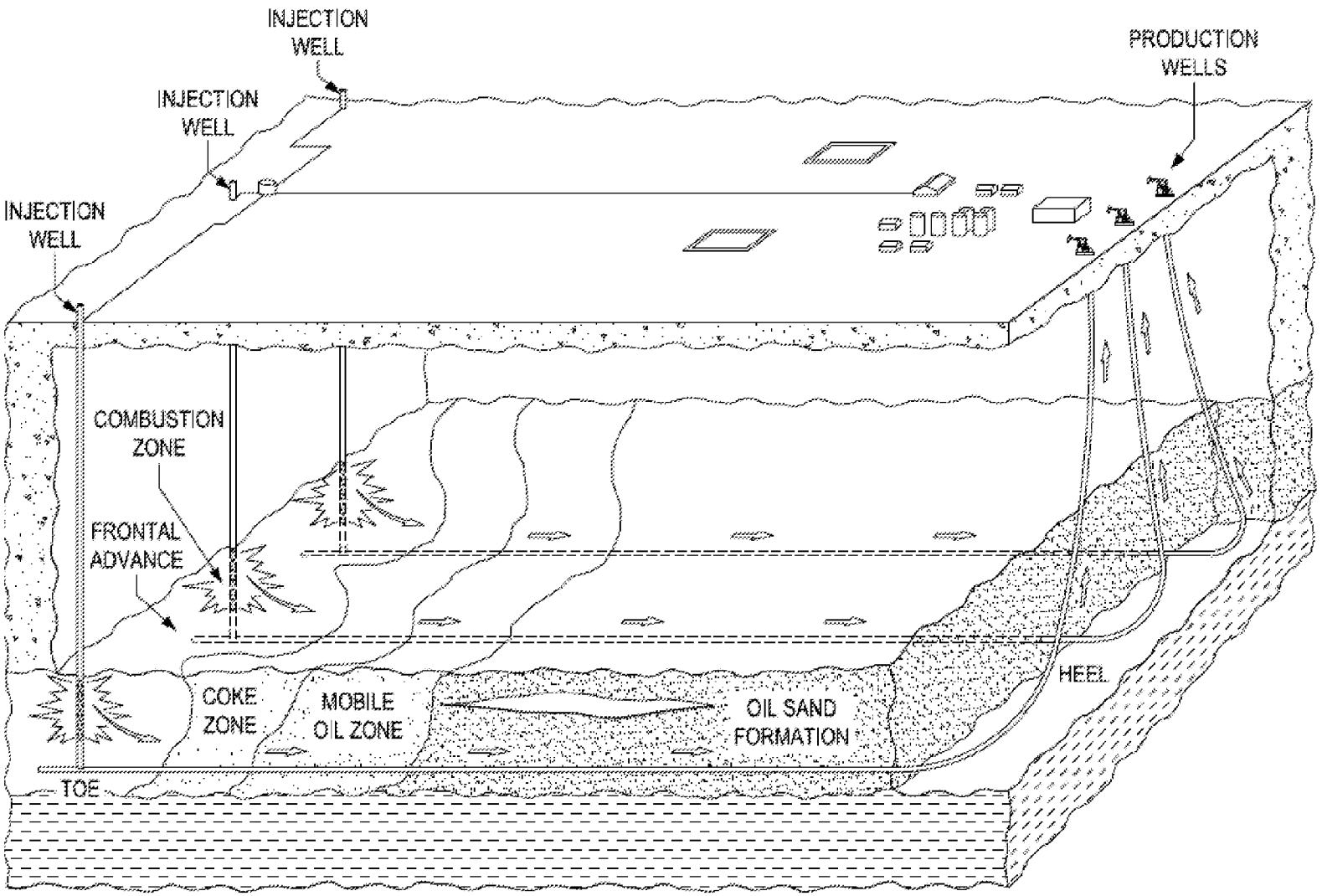
FIG. 2 shows a toe to heal air injection method.

The inventive method combines EM heating of heavy oil in a reservoir with combustion processes. EM heats the heavy oil until fluid communication is achieved between a pair of wells. Then air is injected into the injection well, and ignition is either initiated or proceeds spontaneously. The combustion front mobilizes and upgrades the oil, allowing production of an upgraded heavy oil at the production well.

Preferably, the method is combined with gravity-assisted drainage, so that gravity aids in oil drive. Thus, the production well at least is horizontal, and preferably both wellbores can be horizontal. Also preferably, the method eliminates or at severely reduces the amount of water used in productions methods, although water usage is not necessarily precluded.

Three major issues have prevented combustion processes from being successful in the past. They are pressure communication, heat, and injectivity. In the past, steam has been used to preheat the formation to get past these three issues, but steam preheating can take significant time, since injectivity is often quite limited. Some proposed reservoir conditioning processes take over three years to prepare the reservoir for air injection. Using RF radiation to preheat the reservoir shows great promise as an alternative technique as it does not require injectivity to heat the reservoir, because the EM radiation can penetrate deep into the reservoir without having prior fluid communication. Thus, substantial cost savings can be expected.

This process uses electromagnetic radiation with air injection and in situ combustion as novel EOR method. It can be used in areas that are not considered economic for steam injection methods, or in areas that steam injection is not possible, and even where steam injection is practical, the method serves to reduce water consumption and thus be of significant environmental benefit.

This process can recover bitumen or heavy oil without using source water. Environmental regulations for the use of water to produce from bitumen reservoir are poised to get more stringent in the near future as water becomes an increasingly limited and costly natural resource. This process will eliminate or at least greatly reduce the need for source water in bitumen or heavy oil production.

The invention will also reduce the capital expenses for heavy oil recovery. Since oil can be produced without any steam injection, there will be no need to separate the produced water and oil mixture. Also, there will be no need for water treatment or steam generation facilities for this process.

In order to study the feasibility of the invention, thermal simulations were undertaken. FIGS. 3 and 4 show a numerical simulation of a RF heating and air injection process in an Athabasca type reservoir using the Computer Modeling Group Ltd STARS™ and proprietary reservoir and electromagnetic coupling software. In these figures, temperature is in ° C. and the fraction of oil saturation is based on 1 being 100% oil.

Figure 3A:
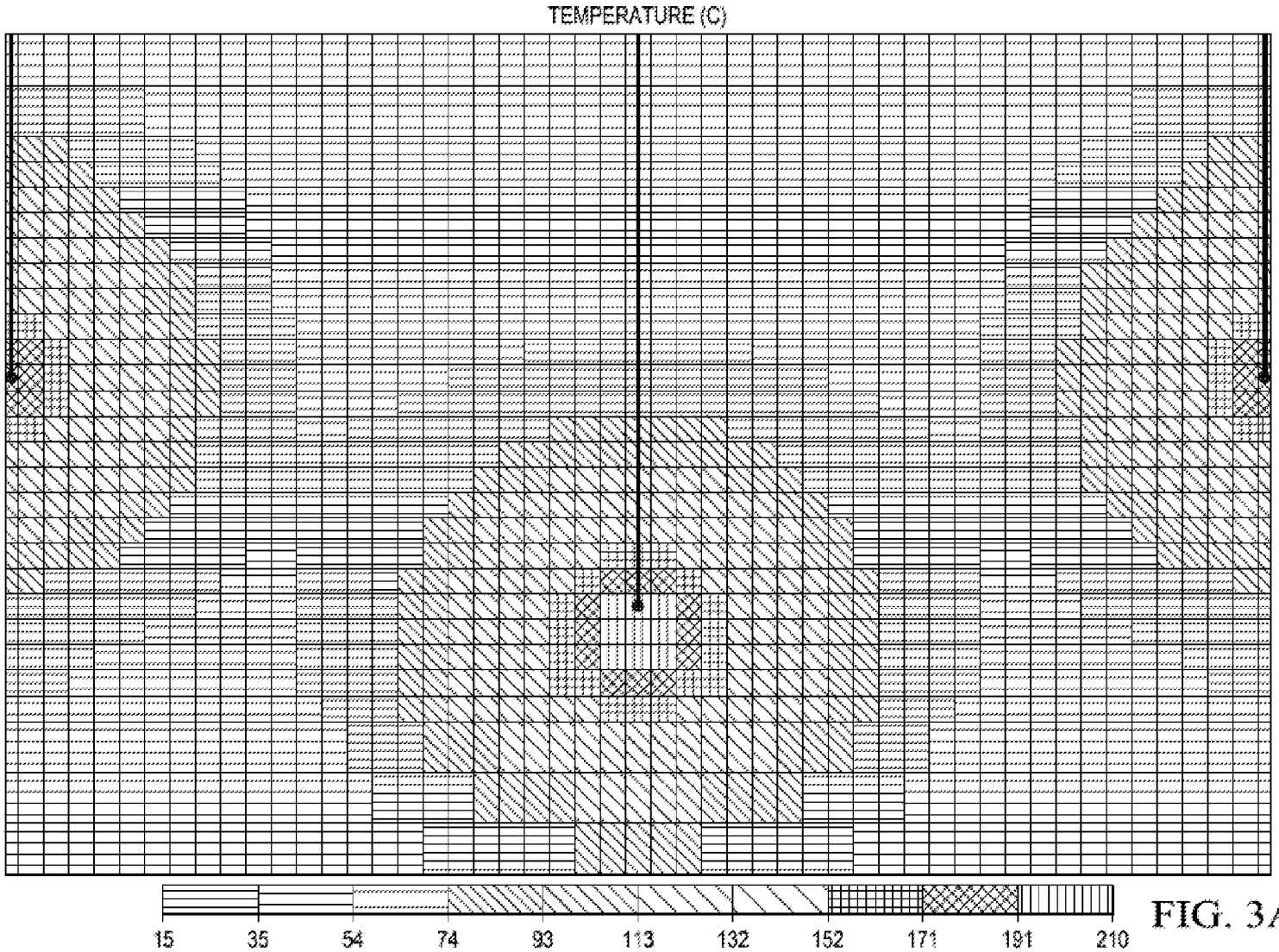
FIG. 3A depicts the formation temperature in degrees Celsius.
Figure 3B:
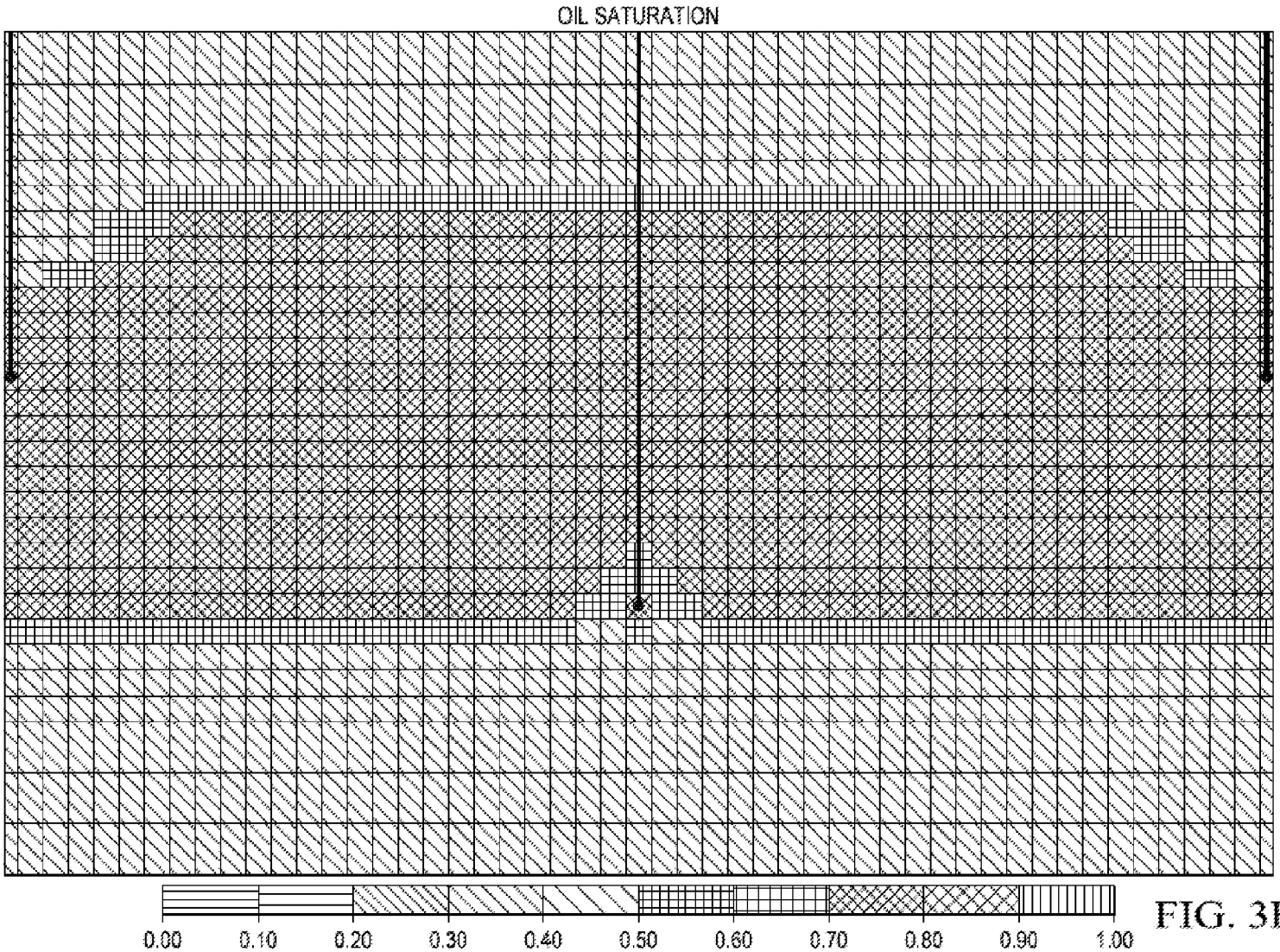
FIG. 3B depicts the fractional oil saturation (1=100% oil) in the reservoir during RF preheat.
Figure 4A:
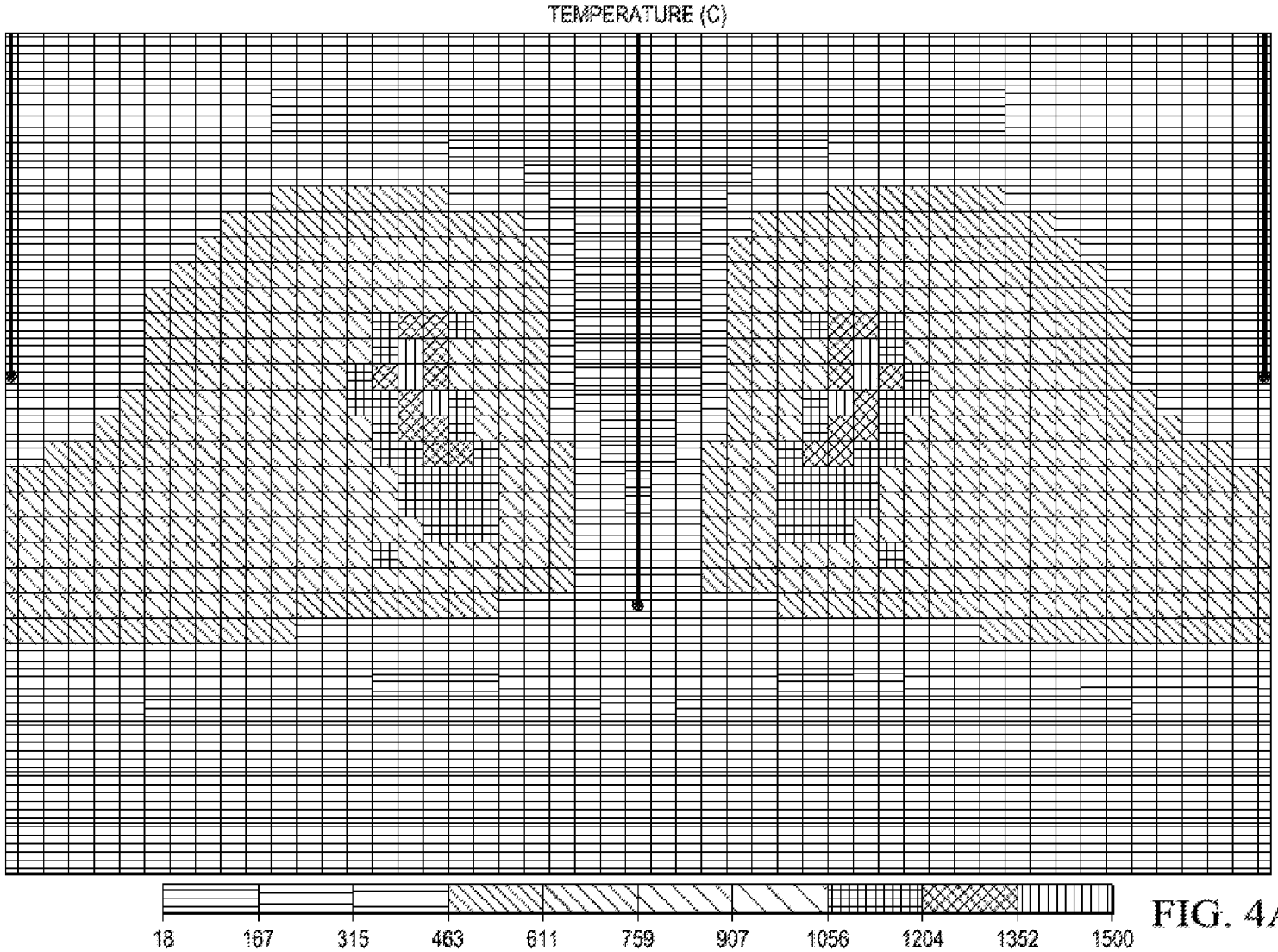
FIG. 4A depicts the formation temperature and FIG. 4B depicts the oil saturation in the reservoir during air injection.

FIGS. 3A and B shows formation temperature and oil saturation, respectively, while using RF to preheat the reservoir prior to air injection. In this case, two horizontal wells are drilled near the top of the formation fifty meters apart (shown in the left and right edges of the figures). A producer is drilled half way in between the two injectors near the bottom of the oil-bearing formation. Each of the three wells is equipped with a RF antenna (depicted as a thick black line with a circle end) for heating the formation. RF heating commences and bitumen is produced from all three wells via gravity drainage until enough heat is transferred to the reservoir to create mobility between the wells. Fluid communication is indicated by the onset of fluid mobility between wells.

Figure 4B:
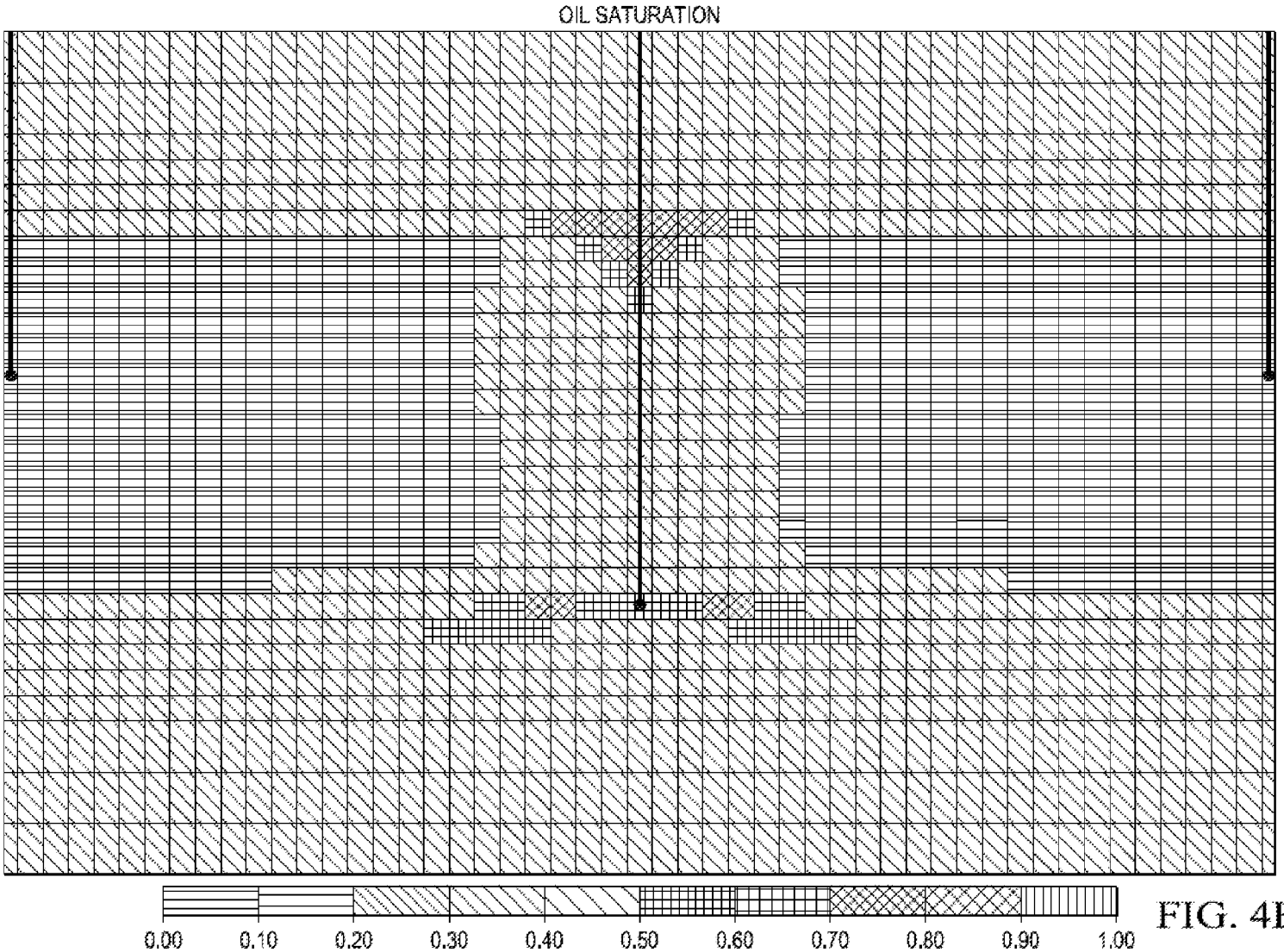

Once pressure communication is established, the upper two wells begin air injection, which creates a combustion front that moves across the reservoir toward the center production well. FIGS. 4 A and B shows the same reservoir after the combustion front has swept through the reservoir. FIG. 4 depicts the temperature distribution of the oil, which mimics the general shape of the combustion front. As shown in FIG. 4B, the oil saturation behind the combustion front is near zero, showing the superior sweep efficiency realized using a combustion process. Injected gas can be air, oxygen enriched air, or pure oxygen. In this simulation, plain air (21% oxygen) was used to create the combustion front. For simplicity in modeling, 0% humidity was used, but this is not essential in a real ISC process.

Figure 5:
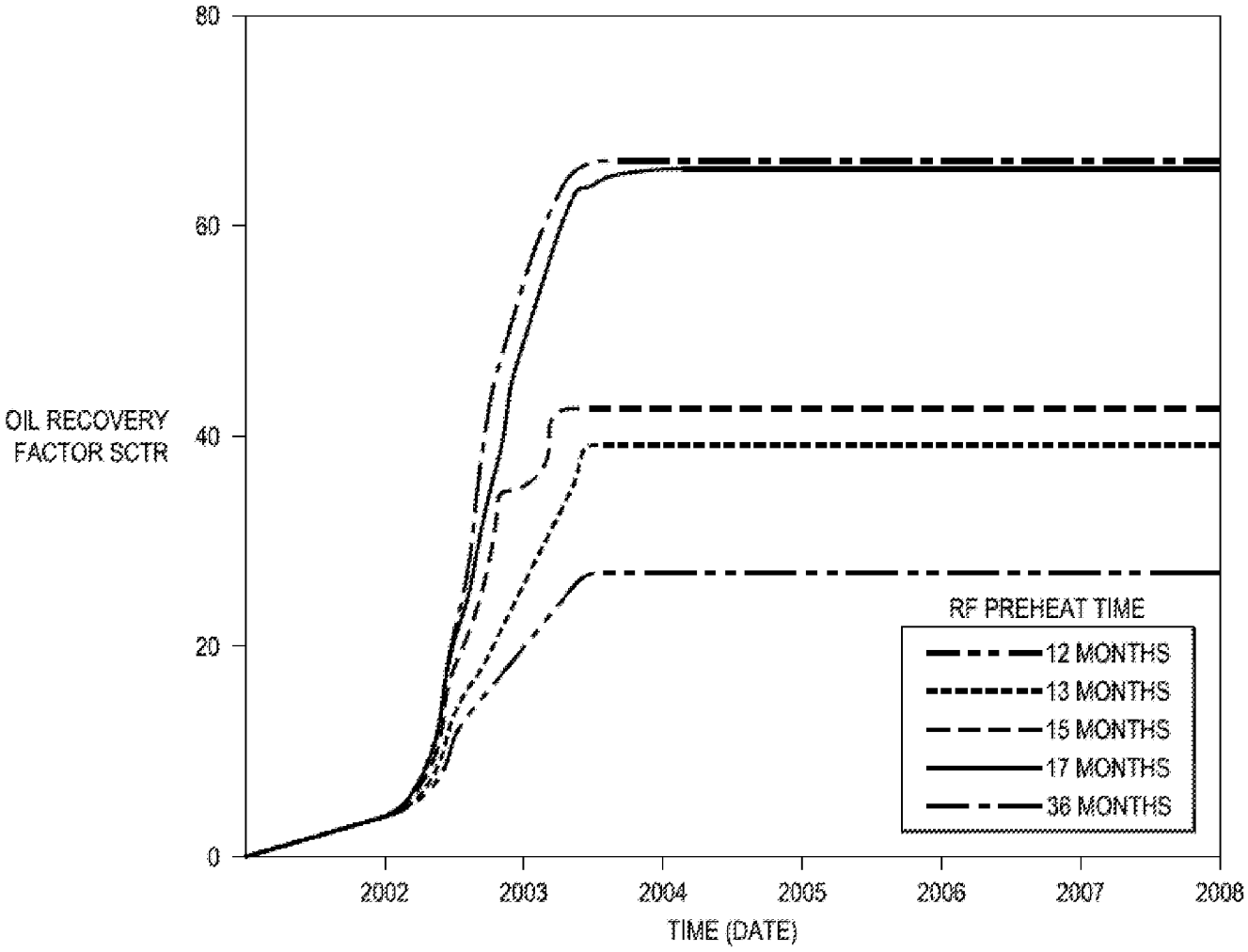
FIG. 5 is comparison of oil recovery factor for different RF heating durations prior to air injection.

FIG. 5 shows the recovery factors for this process using several heating durations to condition the reservoir prior to air injection. Recovery factors over 65% are seen at only 17 months of pre-heating the formation before air injection and further optimization of this process can yield an even higher percentage recovery. This is in contrast to the three-year pre-heat required for steam-based methods under otherwise similar simulation conditions.

Table 1 compares the total heat injected into the reservoir using steam assisted gravity drainage process and using a RF and air injection process. The heat required by the combustion process is less than half of that required by SAGD. Reducing the energy required for recovery can equate to significant reduction in operating expenses for a project. This table also illustrates that the RF air injection process uses no water. This translates into increased profits by reducing capital required for steam generation and water handling and treatment facilities.

TABLE 1

| Process | Water/Oil Ratio bbl/bbl | Total Energy GJ/bbl |
|---|---|---|
| SAGD | 4.15 | 1.8 |
| RF & ISC | 0 | 0.3-0.9 |

The preferred embodiment of this invention uses long horizontal wells and gravity assisted drainage, but other well configurations, such as vertical wells or a combination of vertical and horizontal wells can be used in the same manner to exploit the heavy oil or bitumen reservoir. Well spacing can also be configured to optimize recovery from a particular reservoir.

FIG. 6 shows various schematics of antenna and well configurations that may be employed for the air injection recovery process with RF heating in a gravity drainage embodiment. Each subfigure represents a cross section of the pay-zone with the axis of a well running perpendicular to the page.

Figures 6A, 6B, 6C, 6D, 6E:
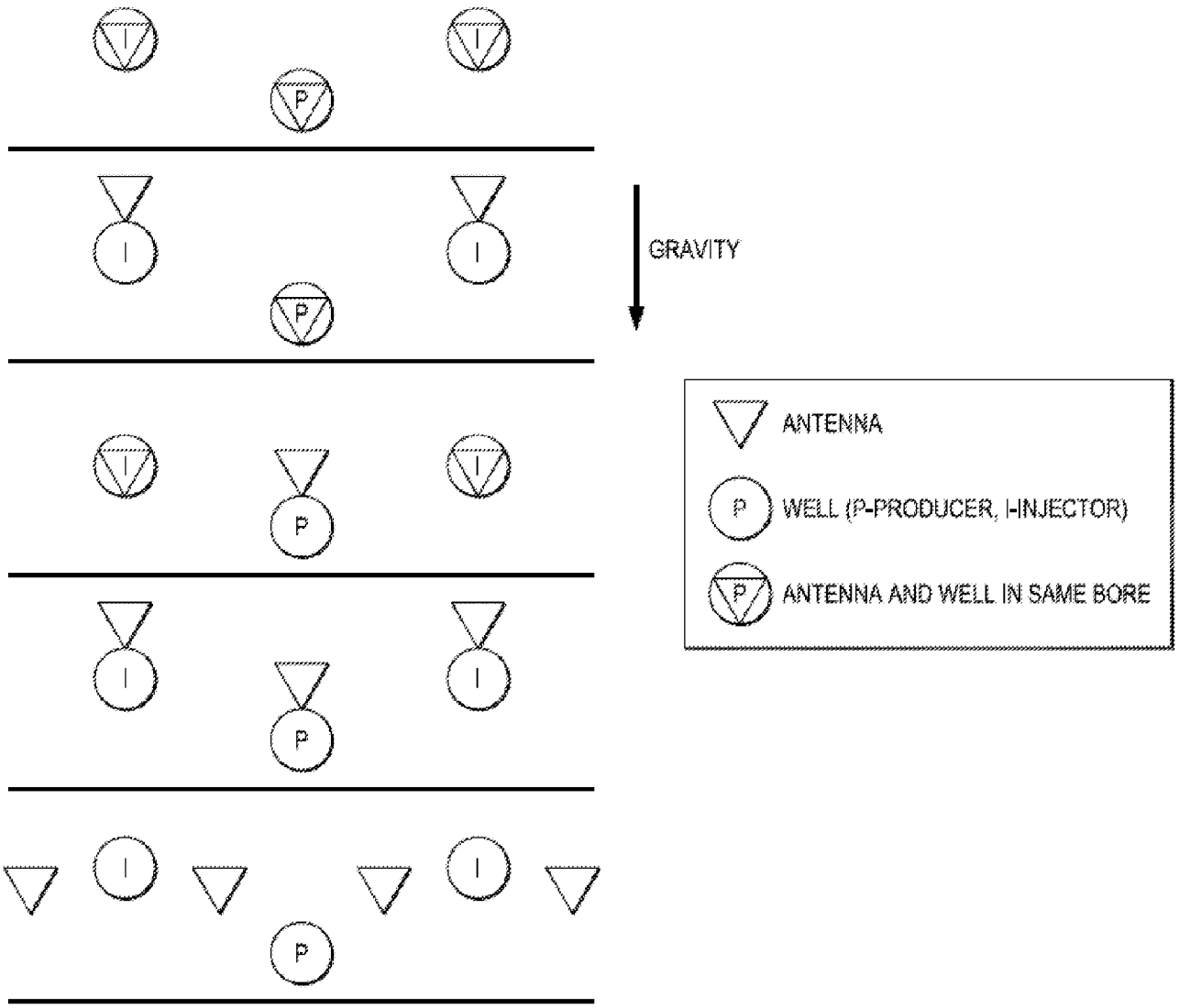
FIG. 6A-E are possible antenna and well configurations for the RF air injection recovery process.

FIG. 6A is a preferred configuration with three wells in a repeating pattern, each with a collocated antenna. Two of the upper wells are injectors, the lower well is a producer. An antenna transduces electromagnetic energy into the hydrocarbon and this energy induces eddy currents that heat the formation volumetrically. The RF induced electromagnetic heating is utilized to increase the formation temperature sufficiently such that the hydrocarbon becomes mobile. At this stage air can be injected into the formation at the injectors. The air creates a combustion front that displaces the oil to the producer where it is collected.

FIG. 6B is another embodiment that utilizes an additional antenna positioned above the two injector wells shown. Other configurations are shown in FIG. 6C to 6D and are permutations of the preferred embodiment.

FIG. 6E is another embodiment that utilizes an antenna positioned horizontally between an injector and producer well. Pressure communication between the injector and producer is more readily established due to the reduced distance between the antennae that provide the heat to the formation. In the schematic shown in FIG. 6E the injectors and producer may be initially stimulated with steam or other common practice method to assist in preheating the formation.

The proposed operating frequency range is between 1 kHz and 100 MHz. It is anticipated that the frequency may vary during the recovery process to maintain optimal coupling with the reservoir. A common dipole is an example antenna form that can be employed as the transducer, although the present invention is not limited to the use of this transducer type.

For some embodiments, the electromagnetic frequency generator defines a variable frequency source of a preselected bandwidth sweeping around a central frequency. As opposed to a fixed frequency source, the sweeping by the radio frequency generator can provide time-averaged uniform heating of the hydrocarbons with proper adjustment of frequency sweep rate and sweep range to encompass absorption frequencies of constituents, such as water and the RF energy absorbing substance, within the mixture.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The following are incorporated herein by reference in their entireties for all purposes:

Heavy Oil and Natural Bitumen Resources in Geological Basins of the World: Open File-Report 2007-1084 (US Geological Survey 2007), at pubs.usgs.gov/of/2007/1084/OF2007-1084v1.pdf CSUG/SPE 136611: Heavy Oil and Bitumen Recovery Using Radiofrequency Electromagnetic Irradiation and Electrical Heating: Theoretical Analysis and Field Scale Observations (2010), available at http://www.spe.org/events/curipc/2010/pages/schedule/tech_pro gram/documents/spe1366111.pdf A. Sahni, et al, Electromagnetic Heating Methods for Heavy Oil Reservoirs (2000), SPE preprint at https://e-reports-ext.llnl.gov/pdf/237930.pdf SPE150550-MS, Igor Bogdanov, et al., Comparative Analysis of Electromagnetic Methods for Heavy Oil Recovery (2011).

WO2012037334 ("Cyclic Steam Stimulation Using RF").

WO2012037230 ("Enhanced Recovery And In Situ Upgrading Using RF").

WO2012037221 ("Inline RF Heating For SAGD Operations").

WO2012037176 ("RF Fracturing To Improve SAGD Performance").

WO2012037147 ("Gravity Drainage Startup Using RF & Solvent).

US2012090844 ("Simultaneous Conversion And Recovery of Bitumen Using RF").

US20120085537 ("Heavy Oil Recovery Using SF6 And RF Heating").

Ser. 61/570,337, Filed Dec. 14, 2011 ("In Situ RF Of Stacked Pay Zones").

Ser. No. 13/455,959, Filed Apr. 25, 2011 ("In Situ Catalytic Upgrading Using RF Radiation").

Ser. No. 13/476,124, May 31, 2011 ("Cyclic Radio Frequency Stimulation").

Ser. 61/584,963, Jan. 10, 2012 (Heavy Oil Production With EM Radiation And Gas Cap").

The invention claimed is:

1. A method of producing heavy oil, comprising:

a. providing an air injection borehole and a production borehole in a reservoir comprising heavy oil;

b. providing an antenna operably connected to a power source in said air injection borehole or said production borehole or both boreholes;

c. heating said heavy oil with electromagnetic (EM) radiation via said antenna until said air injection borehole and said production borehole are in fluid communication;

d. injecting air into said air injection borehole;

e. igniting and allowing a combustion front to mobilize said heavy oil; and f. producing said mobilized heavy oil from said production borehole.

2. The method of claim 1, wherein said production borehole is a horizontal borehole.

3. The method of claim 1, wherein said air injection borehole and said production borehole are each horizontal boreholes, and wherein said air injection borehole is above said production borehole.

4. The method of claim 1, wherein said combustion front upgrades said heavy oil and wherein an upgraded heavy oil is produced from said production borehole.

5. The method of claim 1, where the EM is at a frequency of 1 kHz-100 MHz.

6. The method of claim 1, where said antenna is a dipole antenna.

7. The method of claim 1, where the EM is at a frequency of 1 kHz-100 MHz and said antenna is a dipole antenna.

8. The method of claim 1, wherein said production borehole further comprises an upgrading catalyst.

9. The method of claim 1, wherein said igniting step occurs spontaneously.

10. The method of claim 1, further including the step of igniting said heavy oil.

11. The method of claim 1, wherein there are a plurality of horizontal air injection boreholes above a plurality of production boreholes.

12. The method of claim 1, wherein there are a plurality of horizontal air injection boreholes about 3-5 meters above a plurality of production boreholes.

13. The method of claim 1, wherein there are a plurality of horizontal air injection boreholes about 3-5 meters above a plurality of production boreholes, and each borehole is collocated with an antenna.

14. The method of claim 1, wherein there are a plurality of horizontal air injection boreholes about 3-5 meters above a plurality of production boreholes, and each borehole is collocated with a dipole antenna, and said EM is at a frequency of 1 kHz-100 MHz.

15. An improved method of in situ combustion, wherein air is injected into an injection well and heavy oil is mobilized by a combustion front to be produced at a production well, the improvement comprising first preheating the injection and production wells with electromagnetic radiation until the wells are in fluid communication before injecting air into said injection well for in situ combustion.

16. The method of claim 15, wherein said electromagnetic radiation is a frequency between 1 kHz-100 MHz.

17. An improved method of gravity assisted in situ combustion, wherein air is injected into one or more horizontal injection wells and heavy oil is mobilized by a combustion front to be produced at one or more lower horizontal production wells, the improvement comprising first preheating the injection and production wells with electromagnetic radiation of a frequency between 1 kHz-100 MHz until the wells are in fluid communication before injecting air into said injection wells for in situ combustion.

18. The method of claim 1, wherein a downhole ignition device initiates said igniting step.

* * * * *